US005738409A

United States Patent [19]

Bursik

[11] Patent Number: 5,738,409

[45] Date of Patent: Apr. 14, 1998

[54] ROCKING CHAIR CONSTRUCTION

[76] Inventor: Thomas A. Bursik, 1427 W. King St., Owosso, Mich. 48867

[21] Appl. No.: 780,547

[22] Filed: Jan. 8, 1997

[51] Int. Cl.[6] ..... A47C 3/02

[52] U.S. Cl. ..... 297/265.1; 297/326

[58] Field of Search ..... 297/302.5, 302.6, 297/302.7, 302.1, 302.2, 302.4, 258.1, 264.1, 265.1, 266.1, 326

[56] References Cited

U.S. PATENT DOCUMENTS

| | | |
|---|---|---|
| 77,117 | 4/1868 | Smith . |
| 96,211 | 10/1869 | Emerson . |
| 117,132 | 7/1871 | Winchester . |
| D. 142,094 | 8/1945 | Kirkpatrick . |
| 586,859 | 7/1897 | Michaelson . |
| 1,449,279 | 3/1923 | Gibson . |
| 1,570,096 | 1/1926 | Stransky . |
| 2,018,825 | 10/1935 | Wood . |
| 2,032,773 | 3/1936 | Smith . |
| 2,227,717 | 1/1941 | Jones . |
| 2,329,673 | 9/1943 | Wood . |
| 2,516,172 | 7/1950 | Baldwin . |
| 2,531,572 | 11/1950 | Knoedler . |
| 2,562,041 | 7/1951 | Keller et al. . |
| 2,591,144 | 4/1952 | Fleischer . |
| 2,606,592 | 8/1952 | McIntyre . |
| 2,690,786 | 10/1954 | Sedlock . |
| 4,632,455 | 12/1986 | Schiller et al. . |
| 4,832,402 | 5/1989 | Zund . |
| 4,858,993 | 8/1989 | Steinmann . |

FOREIGN PATENT DOCUMENTS

| | | |
|---|---|---|
| 643222 | 9/1923 | France . |
| 24412 | 10/1913 | United Kingdom . |

*Primary Examiner*—Milton Nelson, Jr.
*Attorney, Agent, or Firm*—Learman and McCulloch

[57] ABSTRACT

A rocking chair has a base frame fitted with mounting brackets adjacent the floor to which lower ends of support legs of a chair frame are secured to enable a chair frame to rock about a transverse rocking axis closely adjacent the floor. A spring shock assembly is mounted beneath the seat portion and is coupled at its upper end directly to the chair frame and at its lower end to the forward arm of a reaction lever pivoted to the base frame. A rearward arm of the lever is coupled by a rigid tie rod to the back of the chair frame. The spring shock biases the chair frame constantly forwardly and is overcome when a person is fully seated and leans back in the chair causing it to rock rearwardly. The shock dampens the movement of the chair. The leverage applied to the spring shock can be adjusted by adjusting the longitudinal position of attachment of the tie rod.

14 Claims, 4 Drawing Sheets

10
26
46
60
48
34
44
52
44
52
54
56
48
54
50
128
58
40
42
50
32
104
36
56
28
36
30
126
38
68
62
82
18
66
112
62
64
62
68
64
14
70
22
69
76
P
84
20
66
69
76
70
R
12
16
14

10
46
48
26
52
52
34
44
44
54
54
48
56
56
38
104
50
50
28
36
36
62
94
109
100
90
82
62
66
96
66
88
84
64
98
86
112
92
P
64
78
115
R
69
69
72
72
F
16
74
70
74
76
72
112
110
111
74
72
78
70
74
76
12a

ROCKING CHAIR CONSTRUCTION

This invention is directed to rocking chairs and more particularly the rocking mechanisms of such chairs.

BACKGROUND OF THE INVENTION

A conventional rocking chair is normally constructed in the form of a straight back chair having curved rockers attached to the bottom of the legs enabling the chair to rock forward and backward on the rockers. The back and forth movement of the chair as it rocks is very comforting in large part because the seat portion of the chair not only pivots but also is displaced longitudinally. One disadvantage to these types of rocking chairs is that they rock freely forwardly and rearwardly, making them somewhat unstable and difficult for some persons to get up from as well as lower themselves into the chair.

Another common type of rocking chair construction is disclosed in U.S. design patent D142,094 in which the chair body is pivoted to an upstanding base at or just below the level of the seat, and the pivotal movement of the chair is opposed by a spring. Such chairs are equally difficult to get into and out of as the chair pivots freely forwardly and rearwardly when the user sits in or rises from the chair. Further, the elevated location of the pivot axis at or just below the seating surface restricts movement of the chair such that it pivots, but does not travel to any significant extent longitudinally forwardly and rearwardly as the chair rocks like the traditional rocking chairs described above.

U.S. Pat. Nos. 2,591,144, 4,832,402, and 4,858,993 disclose chairs similar in construction to the type described in the previous paragraph, but wherein the pivot axis is located adjacent the front edge of the seat rather than midway between the front and back edges. While such forward location of the pivot axis lends some stability to the chair by preventing forward tipping, it is at the expense of eliminating the desirable rocking movement of the chair in which the seat of the chair not only pivots but is displaced longitudinally forwardly and rearwardly like traditional rocking chairs of the first type described above.

SUMMARY OF THE INVENTION AND ADVANTAGES

A rocking chair constructed according to the invention comprises a stationary base frame having a lower floor-engaging surface, a chair frame having a seat portion with longitudinally spaced front and back edges, a backrest projecting upwardly from the seat portion adjacent the back edge thereof, and laterally opposed support legs fixed rigidly to the seat portion and projecting downwardly therefrom to lower ends spaced substantially below the seat portion and coupled by a pivot connection to the base frame about a single, generally horizontal rocking axis spaced midway between the front and back edges of the seat and closely adjacent the lower floor-engaging surface of the base frame, providing longitudinal rocking movement of the seat portion along an arcuate path concentric with the rocking axis. A spring shock assembly coacts between the base frame and chair frame and includes a spring which constantly biases the chair frame forwardly about the rocking axis and a shock absorber biased constantly by the spring toward a fully extended condition during a forward-most position of the chair frame. The spring and shock absorber are compressible to provide dampened rearward rocking movement of the chair frame about the rocking axis from the forward-most position to a reclined position in response to applying a rearward rocking force to the chair frame sufficient to overcome the opposing force of the spring and shock absorber, and extendable to permit dampened self-return of the chair frame to the forward-most position upon removing the applied force.

Like the traditional rocking chair of the type having curved rockers secured to the bottom of the legs, the rocking chair construction of this invention supports the chair in such way that the seat portion of the chair not only pivots but is displaced longitudinally forwardly and rearwardly during movement of the chair. Such movement is accomplished by locating the rocking axis of the chair frame well below the seating surface adjacent the floor and about midway between the front and back edges of the seat portion. The spring shock assembly restrains the chair frame against forward rocking movement beyond a forwardmost position and further prevents rearward rocking movement of the chair frame until such time as sufficient force is applied to the chair to overcome the spring shock assembly. In this way, the chair is able to retain the desired rocking movement associated with traditional rocking chairs while providing stability to the chair frame, allowing users to get into and out of the chair without having it tip forwardly or rearwardly during the process. Further, the shock absorber dampens the movement of the chair frame as it rocks about the axis, providing a desirable smooth and somewhat restrained action to the chair frame as it rocks on the base. These and other features in advantages of the invention will become more readily understood by those skilled in the art when considered in connection with the accompanying drawings and detailed description below.

THE DRAWINGS

A presently preferred embodiment of the invention is disclosed in the following description and accompanying drawings, wherein.

DETAILED DESCRIPTION

Figure 1:
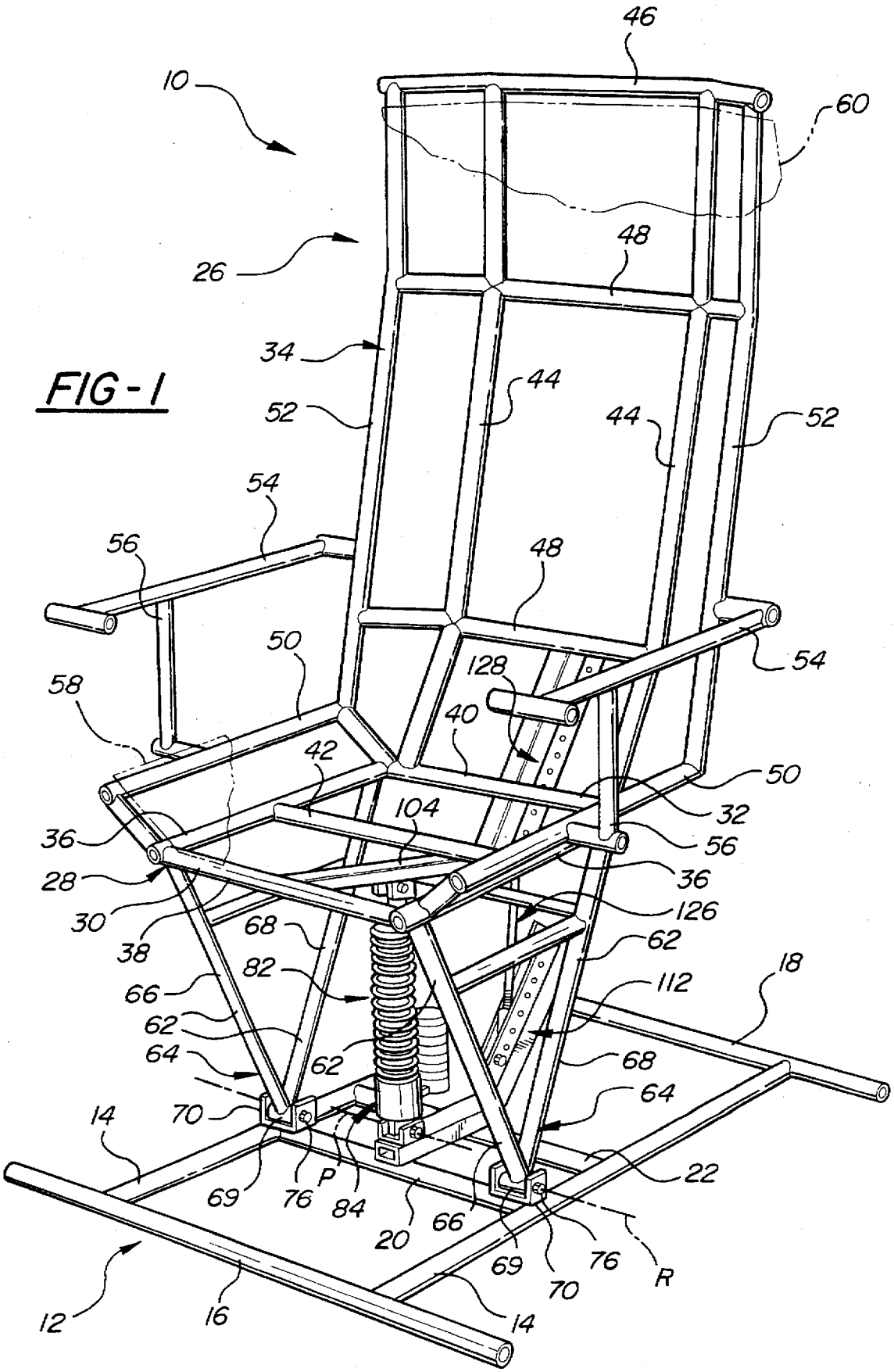
FIG. 1 is a perspective view of the rocking chair.

A rocking chair constructed according to a presently preferred embodiment of the invention is designated generally by the reference numeral 10 in the drawings, and includes a stationary base frame 12 having a pair of laterally spaced side rail members 14 extending longitudinally between opposite front and back ends. The side rails 14 are joined at their ends by front and back cross rail members 16, 18, and at locations between their ends by a pair of intermediate cross rail members 20,22. The members 14–22 are fabricated preferably from tubular metal stock material such as aluminum or steel and are joined together preferably by welding to provide a rigid frame structure. As shown best in FIGS. 2 and 3, the members 14–22 are disposed in a common plane such that when a lower surface of the frame 12*a* engages the floor F or other support surface, the frame 12 is disposed generally horizontal and flat against the floor.

The rocking chair 10 also includes a chair frame 26 having a seat portion 28 extending longitudinally between a front edge 30 and a back edge 32 thereof. A backrest portion 34 of the chair frame 26 extends upwardly from the back edge 32 of the seat portion 28. As shown best in FIG. 1, the seat and backrest portions 28, 34 are preferably fabricated as a rigid open framework of rails and crossmembers much like those of the base frame 12. The seat portion 28 includes a pair of laterally spaced side rails 36 joined at their ends by front and back cross braces 38, 40 and between their ends by an intermediate cross brace 42. Projecting up from the side rails 36 are corresponding side rails 44 of the backrest portion 42. Rails 44 are secured at their lower ends to the back cross brace 40 of the seat portion and are Joined at their upper ends by a top cross brace 46, and between their ends by intermediate cross braces 48.

Side bolsters 50, 52 project from the side rails 36,44 of the seat and backrest portions 28, 34, respectively, and are joined thereto by extensions of the cross braces of the chair frame mentioned above. Laterally spaced arm rests 54 project forwardly from the side bolsters 52 of the backrest portion 34 and are supported in elevated, generally parallel relation above the seat portion 28 by uprights 56. Cushions 58,60 may be mounted on the seat and backrest portions 28, 34 in conventional manner.

A pair of laterally opposed rigid support legs 62 are fixed preferably by welding at their upper ends to the seat portion 28 and preferably the side rails 36 thereof and extend downwardly therefrom to lower ends 64 spaced about midway between the front and back edges 30, 32 of the seat portion 28. As shown best in FIGS. 1 and 3, each support leg 62 includes front and back supports 66,68 that are welded or otherwise fixed at their upper ends adjacent the front and back edges 30–32 of the seat portion 28. The support 66,68 of the legs 62 converge at transversely extending sleeve portions 69 at the lower ends 64 of the legs 62.

The base frame 12 includes mounting brackets 70 for mounting the lower sleeves 69 of the legs 62. Each mounting bracket 70 includes a pair of upstanding ears 72 mounted in laterally spaced relation to one another adjacent the side rails 14 of the base frame 12 by a distance sufficient to accept the lower sleeves 69 of the support legs 62 therebetween. The ears 72 have openings 74 lying along a common transverse horizontal axis at a location closely adjacent the floor F. Mounting pins 76 extend through the openings 74 and through aligned passages 78 of the sleeves 64, defining a generally horizontal transverse rocking axis R about which the chair frame 26 may move with respect to the base frame 12. The mounting pins 76 and thus the rocking axis R is located closely adjacent the floor F well below the level of the seat portion 28 of the chair frame 26 and about midway between the front 30 and back 32 edges of the chair frame 26. In this way, the chair frame 26 is able to rock about the axis R of the sleeves 69 and pins 76, during which the seat portion 28 is displaced longitudinally along a path L (FIG. 4) tracing an arc of an imaginary circle that is concentric with the rocking axis R.

The assembly 10 includes a resilient reaction mechanism 82 acting between the chair frame 26 and the base frame 12 to control the rocking movements of the chair frame 26. The mechanism 82 includes a spring shock assembly 84 supported at one end against axial movement and a leverage assembly 85 coupling the opposite end of the spring shock assembly 84 to the chair frame 26.

Figure 5:
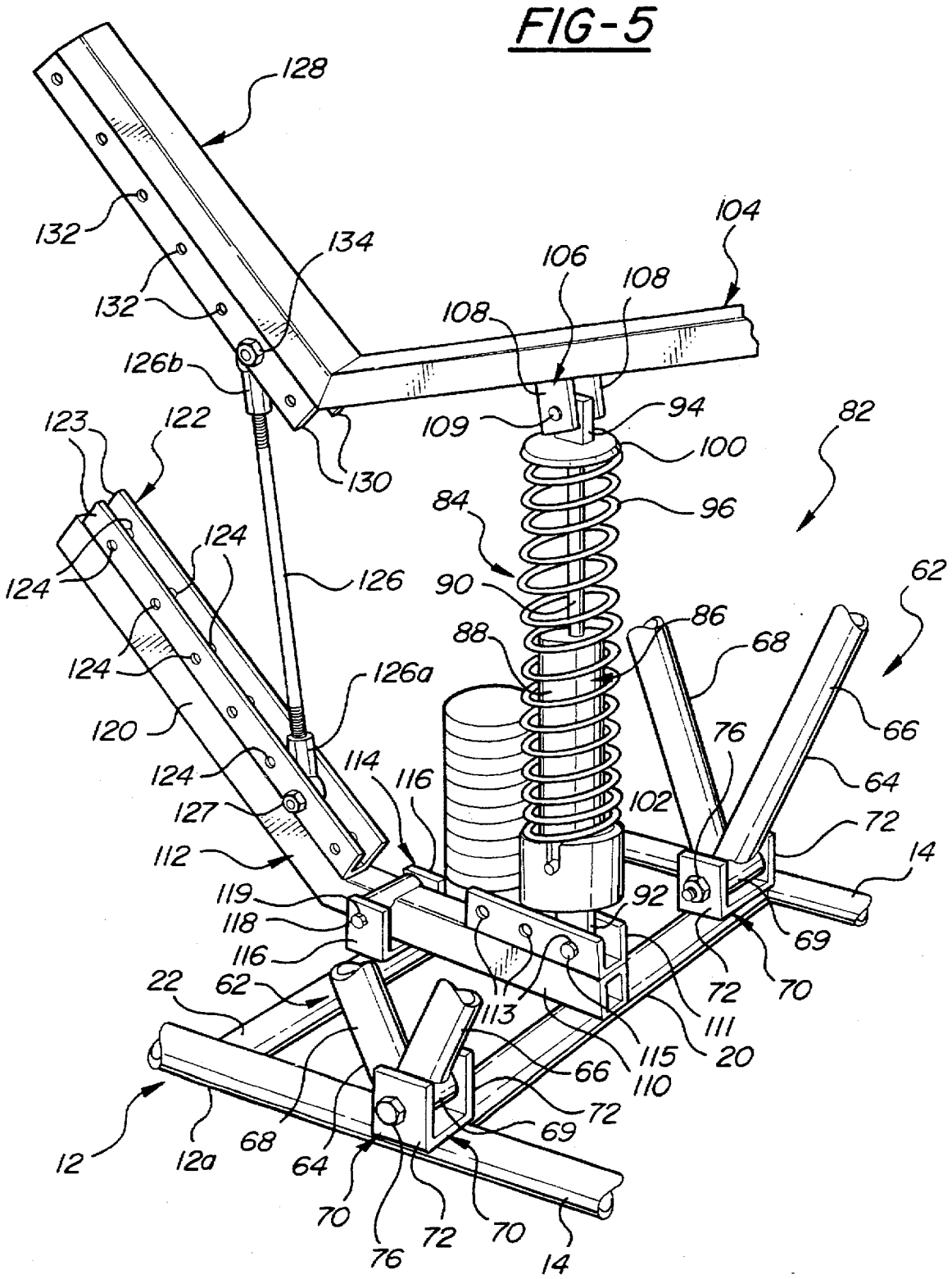
FIG. 5 is an enlarged fragmentary view shown partly in section of the rocking mechanism of the chair.

The spring shock assembly 84 is preferably of the type employed in motorcycle suspension systems and as such includes a double action shock absorber 86 preferably of the hydraulic or gas pressure type having a sealed fluid cylinder 88 containing a fluid such as hydraulic oil or pressurized gas and accommodating a piston (not shown) slidably therein coupled to one end of a piston rod 90 which extends axially therefrom beyond an end of the cylinder 88. The lower free end of the cylinder 88 and, the upper free end of the piston rod 90 are fitted with mounting eyes 92, 94. The assembly 84 also includes a helical compression spring 96 carried by the shock absorber 86 and held at its end by cup-shaped retainers 98,100 attached to the opposite ends of the shock absorber 86 adjacent the mounting eyes 92,94. Preferably, at least one of the retainers is adjustable for varying the spring rate of the spring 96. The means of adjustment may take a number of forms, such as a collar rotatable relative to the spring 96 having a stepped camming surface 102 which, when the sleeve is rotated, increases or decreases the effect of axial length of the sleeve to compress of decompress the spring 96 (FIG. 5).

Figure 2:
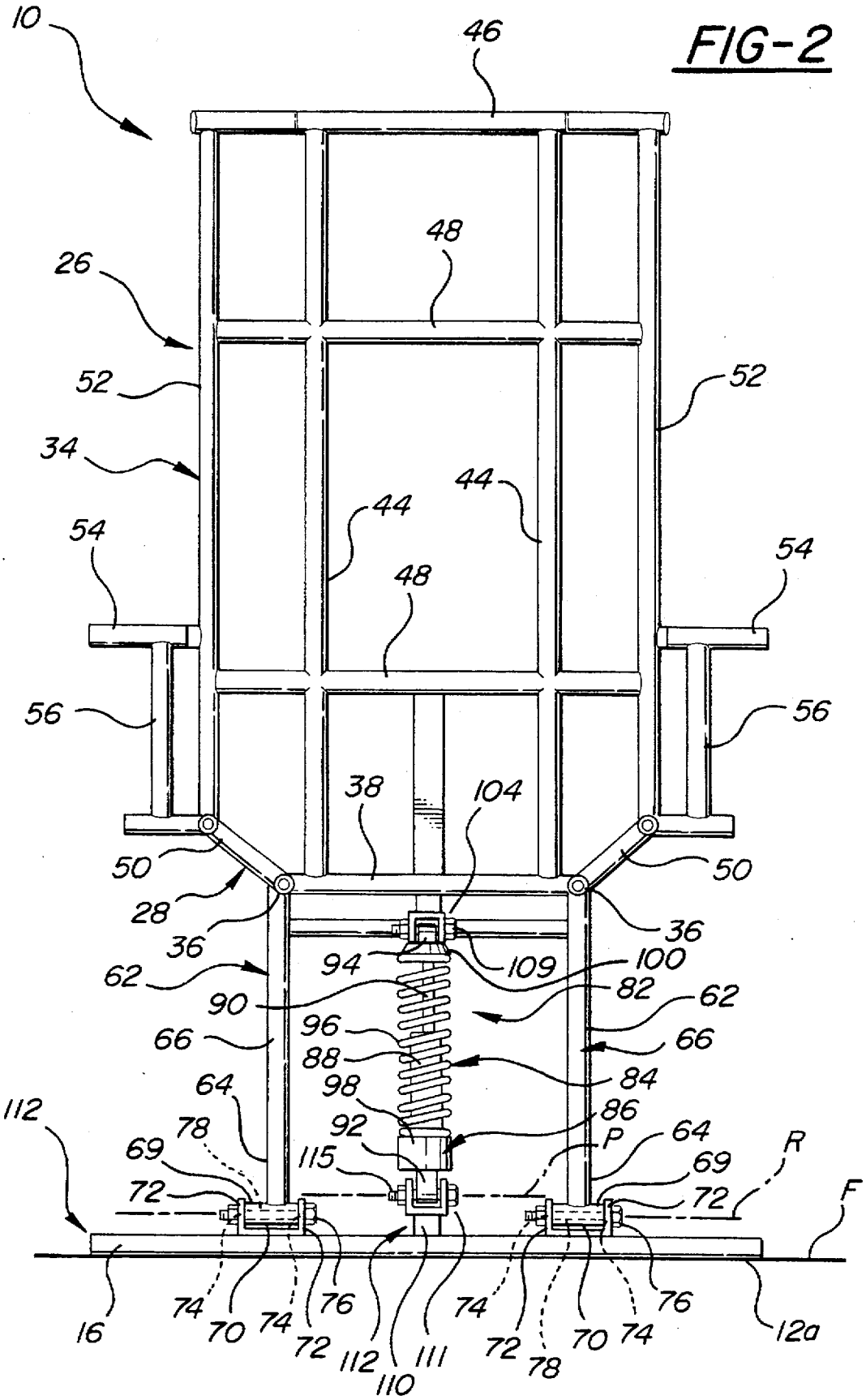
FIG. 2 is a front elevational view of the chair of FIG. 1.
Figure 3:
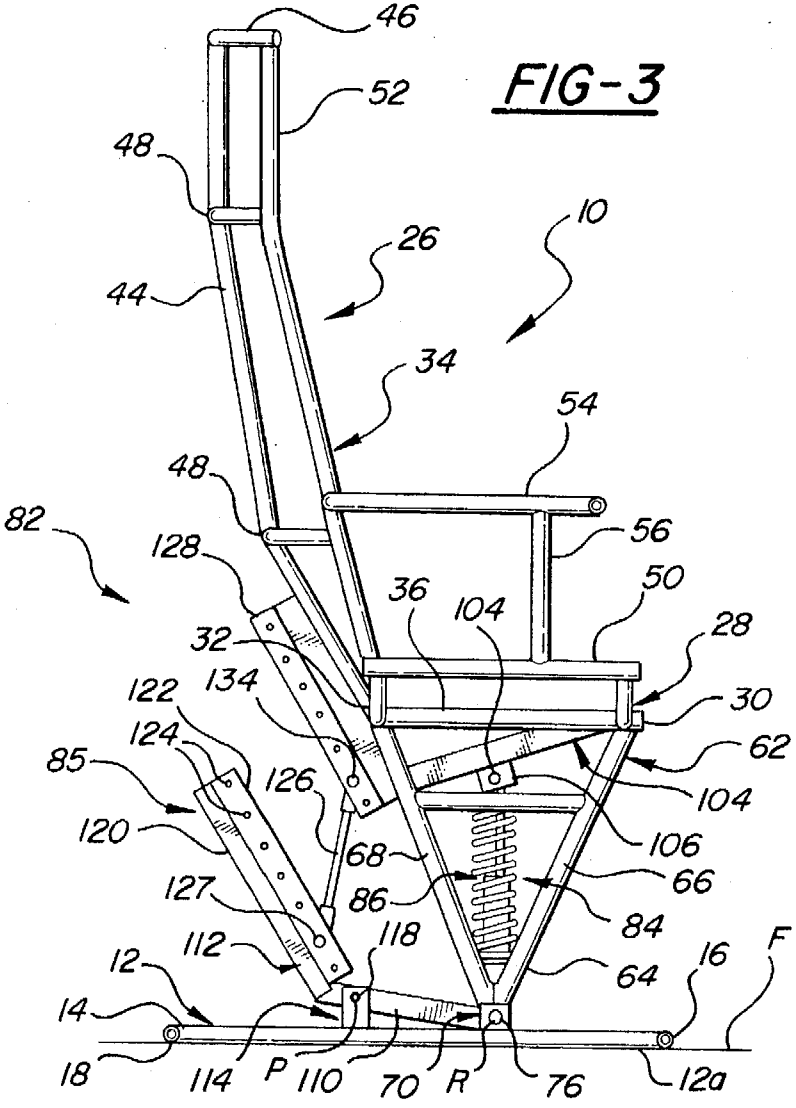
FIG. 3 is a side elevational view of the chair of FIG. 1 shown in the forward-most position.

As shown best in FIGS. 1–3, the spring shock assembly 84 is mounted in a generally upright position beneath the chair frame 26, preferably generally radially in line with the rocking axis R. The upper mounting eye 94 is coupled to a fixed mounting bracket 104 of the chair frame 26. The mounting bracket 104 includes a longitudinal U-shaped channel piece 106 opening downwardly to receive the mounting eye 94 between laterally spaced side walls 108 of the channel 106. A mounting pin 109 extends through aligned openings in the side walls 108 and the mounting eye 94 to secure the upper end of the spring shock assembly 84 pivotally but substantially against axial movement relative to the base frame 12 and chair frame 26.

The lower mounting eye 92 of the spring shock assembly 84 is coupled to a U-shaped channel bracket 111 of a front or forward or second arm 110 of a longitudinal reaction lever 112 of the leverage assembly 86 at a location closely adjacent the rocking axis R of the chair 10. The bracket 111 has at least one and preferably a plurality of aligned mounting hole sets 113 to receive a mounting pin 115 engaging the lower eye 92 of the spring shock 84 (FIG. 5). The reaction lever 112 is coupled pivotally to the base frame 12 about a pivot axis P parallel to but spaced rearwardly from the rocking axis R. As shown best in FIGS. 2 and 5, the support for the reaction lever 112 is much like that provided for the support legs 62, and includes a rigid mounting bracket 114 welded or otherwise fixed to the base frame 12 rearwardly of brackets 70 and including laterally spaced ears 116 that project upwardly on opposite lateral sides of the lever 112. A pivot pin 118 extends through aligned openings 119 in the ears 116 and lever 112.

The reaction lever 112 includes a second or back or first arm 120 extending longitudinally rearwardly of the pivot axis P opposite the forward arm 110 and preferably upwardly at an angle of about 45° with respect the horizontal base frame. The second arm 120 is substantially longer than the forward arm 110. A bracket 122 is secured to the second arm 120 and has laterally spaced upstanding side walls 123 formed with a plurality of longitudinally spaced aligned openings 124 for pivotal attachment to a lower end 126*a* of a rigid tie rod linkage 126 by a pivot pin 127 installed in a selected set of the aligned openings 124 and through the upper end 126*a* of the tie rod 126. An upper U-shaped bracket 128 is welded to the chair frame 26 at an upward angle generally parallel to the second arm 120 of the reaction lever 112. The upper bracket 128 includes side walls 130 spaced to accommodate an upper end 126*b* of the tie rod 126 therebetween and formed with a plurality of spaced openings 132 to receive a pivot pin 134 for pivotal attachment of the upper end 126*b* of the tie rod 126. The ends 126*a*, 126*b* of the tie rod 126 are preferably fitted with ball joint-type couplings that are threaded onto the ends of the tie rod 126 to provide the pivot connection between the tie rod 126 and the upper and lower brackets 128,122 and further to enable adjustment in the effective length of the tie rod 126 by adjusting the distance by which the couplings extend beyond the ends of the tie rod 126. Such adjustable length swivel or pivot the rod linkages of the type preferred are commonly employed in farm tractor and automotive application as steering components and other movable linkage applications.

THE OPERATION

When the chair 10 is unoccupied such that there are no external forces acting on the chair frame 26, the spring 96 acts against the retainers 98,100 forcing the shock absorber 86 to a fully extended condition, illustrated in FIGS. 1–3. The full extension of the shock 86 rotates the forward arm 110 of the lever 112 downwardly, maintaining it at a position generally horizontal and thus parallel with the base frame 12. The rearward arm 120 in response is rotated upwardly and maintained in the position shown in FIGS. 1–3. The upward displacement of arm 120 is transmitted to the chair frame 26 by the tie rod 126, biasing the chair frame 26 constantly forwardly about the rocking axis R. The full extension of the shock absorber 86 restricts the forward movement of the chair frame to the generally upright, forward-most position shown in FIGS. 1–3 wherein the seat portion 28 of the chair frame 26 is generally horizontal. The forward-most position of the chair frame 20 can, however, be adjusted by adjusting the length of the tie rod 126. Lengthening the tie rod 126 would cause the chair frame 26 to tilt further forwardly in its forward-most position, whereas shortening the tie rod would displace the chair frame 26 rearwardly in its forward-most position.

When a person sits in the chair, the chair frame 26 remains in the forward-most position until such time as the weight of the person is shifted sufficiently rearwardly of the rocking axis R to overcome the opposing force of the spring shock assembly 84. In this way, the chair frame 26 is very stable and remains virtually motionless while the person gets into and out of the chair.

Figure 4:
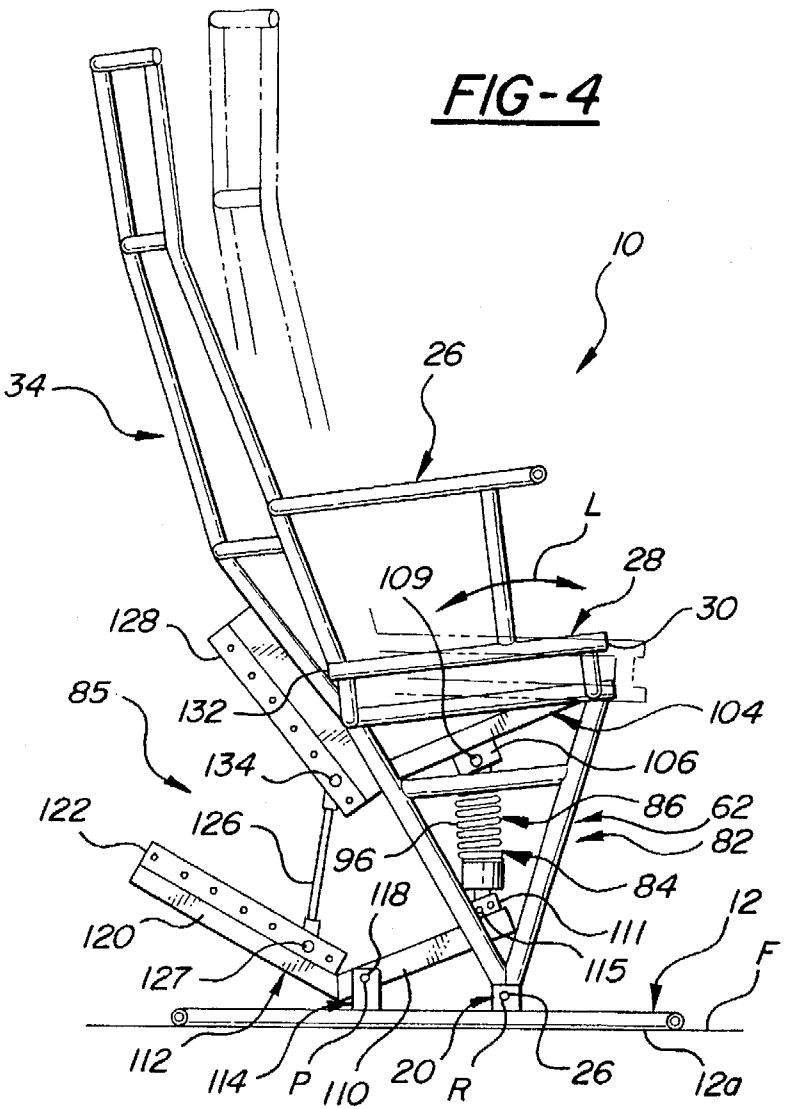
FIG. 4 is a view like FIG. 3 but with the chair shown rocked rearwardly to a reclined position.

As the person sits fully in the chair and leans against the backrest portion 34, a rearward rocking force results with sufficient leverage to overcome the opposing force of the spring 96, causing the chair to rock rearwardly to a reclined position as shown in FIG. 4. As the chair frame 26 tilts rearwardly, the tie rod 126 forces the second arm 120 downwardly which in turn swings the forward arm 110 upwardly compressing the spring 96. As illustrated in FIG. 4, the upper end of the spring shock 84 swings rearwardly with the chair frame about the rocking axis R, but is held against any appreciable axial movement in the radial direction of the rocking axis R.

As the person rocks his body forwardly, it relieves all or some of the rearward force on the chair frame 26, at which point the spring 96 acts to return the chair frame 26 toward the forward-most position. As the chair frame 26 rocks between the upright and reclined positions, the movement is dampened by the double action of the shock absorber 86, producing a smooth, slow and steady motion of the chair frame 26.

The amount of leverage force supplied by the person as he leans back against the backrest portion 34 can be varied by adjusting the longitudinal position of attachment of the tie rod 126 to the second arm 120 and upper bracket 128. If the lower end **126*a* of tie rod 126 were coupled at location rearwardly from the position shown in the drawings, a greater amount of leverage force would be applied to the reaction lever 112, since the rod 26 is connected further outwardly from the pivot axis P, making it easier to rock the chair rearwardly. Likewise, coupling the upper end 126*b* forwardly from the position shown would generate increased lever force as it is nearer to the rocking axis R. Of course, a decrease in leverage results if either the lower end 126*a* is shifted forwardly or the upper end 126*b* is shifted rearwardly. Additional adjustment in the effective leverage can be made by adjusting the longitudinal position of attachment of the lower eye 92 of the spring shock assembly 84 to the forward lever arm 110 with respect to the rocking axis R via the openings 113. Moving the lower end of the spring shock assembly 84** closer to the rocking axis R increases the effective leverage, whereas moving it further away decreases the effective leverage.

The parallel relation of the second arm 120 and upper bracket 128 enables adjustments in the longitudinal position of the attachment tie rod 126 to be made without altering the forward-most position of the chair frame 26.

The disclosed embodiment is representative of a presently preferred form of the invention, but is intended to be illustrative rather than definitive thereof. The invention is defined in the claims.

I claim:

1. A rocking chair construction, comprising:

a stationary base frame having a lower floor-engaging surface;

a chair frame having a seat portion with longitudinally spaced front and back edges, a backrest portion projecting upwardly from said seat portion adjacent said back edge, and laterally opposed support legs fixed rigidly against relative pivotal movement to said seat portion and projecting downwardly therefrom to lower ends spaced substantially below said seat portion;

a pivot connection coupling said lower ends of said support legs to said base frame about a single, generally horizontal rocking axis, said rocking axis being spaced longitudinally about midway between said front and said back edges of said seat portion and closely adjacent said lower floor-engaging surface of said base frame enabling longitudinal rocking movement of said seat portion along an arcuate path concentric with said rocking axis; and a spring shock assembly coacting with said base frame and said chair frame including a spring constantly biasing said chair frame forwardly about said rocking axis and a shock absorber biased constantly by said spring toward a fully extended condition defining a forward-most position of said chair frame, said spring and said shock absorber being compressible to permit dampened rearward rocking movement of said chair frame about said rocking axis from said forward-most position to a reclined position in response to applying a rearward rocking force to said chair frame sufficient to overcome said spring and said shock absorber, and extendible to permit dampened self-return of said chair frame to said forward-most position upon removing said application of said rearward rocking force.

2. The rocking chair construction of claim 1 wherein said base frame comprises a generally rectangular open frame structure including a pair of laterally spaced side rail members interconnected by a plurality of longitudinally spaced cross brace members, said side rail and cross brace members lying in a generally common horizontal plane when supported on the floor and supporting said lower ends of said support legs of said chair frame in close proximity to the floor.

3. The rocking chair construction of claim 2 wherein said base frame includes a pair of laterally spaced mounting brackets secured to said base frame and supporting said lower ends of said support legs.

4. The rocking chair construction of claim 1 including a reaction lever pivotally coupled to said base frame intermediate opposite longitudinal front and back arms thereof for pivotal movement of said lever relative to said base frame about a pivot axis generally parallel with said rocking axis, said back arm of said lever being coupled operatively to said chair frame rearwardly of said rocking axis and said front arm of said lever being coupled operatively to a lower end of said spring shock assembly.

5. The rocking chair construction of claim 4 wherein said spring shock assembly is mounted generally upright beneath said seat portion of said chair frame.

6. The rocking chair construction of claim 4 wherein said spring shock assembly includes an upper end coupled to and moveable with said chair frame about said rocking axis while said upper end is secured by said chair frame against axial displacement during compression and extension of said spring shock assembly.

7. The rocking chair construction of claim 4 wherein said pivot axis of said reaction lever is spaced rearwardly of said rocking axis of said chair frame.

8. The rocking chair construction of claim 4 including a rigid tie rod coupled at an upper end thereof to said chair frame and at a lower end thereof to said back arm of said lever.

9. The rocking chair construction of claim 8 wherein said tie rod is coupled pivotally to said chair frame and said back arm of said lever.

10. The rocking chair construction of claim 8 wherein the position of attachment of said upper end of said tie rod to said chair frame is adjustable in the longitudinal direction of the chair frame relative to the rocking axis.

11. The rocking chair construction of claim 8 wherein at least said back arm of said lever includes an adjustable mounting connection for said lower end of said tie rod enabling the position of attachment of said lower end to said back arm to be adjusted longitudinally relative to said rocking axis.

12. The rocking chair construction of claim 11 wherein said adjustable mounting connection includes a bracket secured to said back arm having upstanding laterally spaced side walls formed with a plurality of longitudinally spaced sets of aligned mounting holes.

13. A rocking chair construction comprising:

a stationary base frame including a pair of laterally spaced side rail members and a plurality of spaced cross brace members interconnecting said side rail members along their lengths, said side rail and cross brace members being generally coplaner and having a lower support surface supporting said base frame horizontally on a support surface, said base frame including a pair of laterally spaced mounting brackets defining a horizontal rocking axis extending laterally across said base frame in close proximity to said lower support surface of said base frame;

a rigid chair frame supported on said base frame including a seat portion having front and back edges and a backrest portion projecting upwardly from said seat portion adjacent said back edge of said seat portion, and a pair of laterally spaced support legs secured rigidly to said seat portion and projecting downwardly therefrom to lower ends, said lower ends being spaced substantially below said seat portion and disposed about midway between said front and back edges of said seat portion;

pivot pins interconnecting said mounting brackets of said base frame and said lower ends of said support legs enabling seat portion of said chair frame to rock about said rocking axis longitudinally along an arcuate path concentric with said rocking axis;

a rigid reaction lever coupled pivotally to said base frame enabling said lever to pivot relative to said base frame about a pivot axis parallel to said rocking axis, said lever including a first longitudinal arm extending rearwardly of said pivot axis and a second longitudinal arm extending forwardly of said pivot axis;

a rigid tie rod linkage having an upper end thereof coupled to said chair frame rearwardly of said rocking axis and a lower end coupled to said first arm of said lever rearwardly of said pivot axis such that rocking movement of said chair frame about said rocking axis causes corresponding pivotal movement of said lever about said pivot axis; and a spring shock assembly mounted in generally upright position beneath said seat portion having an upper end thereof coupled pivotally to said seat portion for movement therewith about said rocking axis while being supported by said chair frame against axial movement, said spring shock assembly having a lower end thereof coupled pivotally to said second arm of said lever forwardly of said rocking axis, said spring shock assembly having a compression spring and a shock absorber, said spring constantly biasing said reaction lever toward forward rotation urging said chair frame constantly forwardly about said rocking axis, said shock absorber having a fully extended condition limiting the forward travel of the chair frame and defining a forward-most upright position of said chair frame, said spring opposing rearward rocking of said chair frame from said forward-most position to a reclined position until such time as a rearward rocking force is applied to said chair frame sufficient to apply enough leverage force to said first arm to rock said lever arm rearwardly and compress said spring, said spring acting to return said chair frame toward said forward-most position upon removal of said rearward rocking force, said shock absorber acting to dampen said movement of said chair frame when rocked between said forward-most and said reclined positions, said tie rod being adjustable in its position of attachment to at least said first arm of said lever to adjust said leverage force.

14. A rocking chair construction, comprising:

a stationary base frame having a lower floor-engaging surface;

a chair frame having a seat portion with longitudinally spaced front and back edges, a backrest portion projecting upwardly from said seat portion adjacent said back edge, and laterally opposed support legs fixed rigidly to said seat portion and projecting downwardly therefrom to lower ends spaced substantially below said seat portion;

a pivot connection coupling said lower ends of said support legs to said base frame about a single, generally horizontal rocking axis, said rocking axis being spaced longitudinally about midway between said front and said back edges of said seat portion and closely adjacent said lower floor-engaging surface of said base frame enabling longitudinal rocking movement of said seat portion along an arcuate path concentric with said rocking axis;

a spring shock assembly coacting with said base frame and said chair frame including a spring constantly biasing said chair frame forwardly about said rocking axis and a shock absorber biased constantly by said spring toward a fully extended condition defining a forward-most position of said chair frame, said spring and said shock absorber being compressible to permit dampened rearward rocking movement of said chair frame about said rocking axis from said forward-most position to a reclined position in response to applying a rearward rocking force to said chair frame sufficient to overcome said spring and said shock absorber, and extendible to permit dampened self-return of said chair frame to said forward-most position upon removing said application of said rearward rocking force; and a reaction lever pivotally coupled to said base frame intermediate opposite longitudinal front and back arms thereof for pivotal movement of said lever relative to said base frame about a pivot axis generally parallel with said rocking axis, said back arm of said lever being coupled operatively to said chair frame rearwardly of said rocking axis and said front arm of said lever being coupled operatively to a lower end of said spring shock assembly.

* * * * *